US005584327A

United States Patent [19]

Thomas et al.

[11] Patent Number: 5,584,327

[45] Date of Patent: Dec. 17, 1996

[54] METHOD AND APPARATUS FOR STORING AND DISPENSING CHEMICAL SOLUTIONS

[75] Inventors: John E. Thomas, River Falls, Wis.; Daniel K. Boche, Eagan, Minn.

[73] Assignee: Ecolab Inc., St. Paul, Minn.

[21] Appl. No.: 271,417

[22] Filed: Jul. 6, 1994

[51] Int. Cl.[6] ..... B67D 5/56

[52] U.S. Cl. ..... 141/104; 141/2; 141/9; 141/18; 141/105; 141/234; 141/236; 222/145.5; 137/625.11

[58] Field of Search ..... 141/2, 9, 18, 21, 141/100, 104–107, 234, 236, 248; 222/132, 145.5, 630; 137/625.11

[56] References Cited

U.S. PATENT DOCUMENTS

| | | | |
|---|---|---|---|
| Re. 33,943 | 6/1992 | Arzberger et al. | 62/127 |
| 2,593,733 | 4/1952 | Davies | 137/625.11 |
| 3,785,391 | 1/1974 | Miller | 137/625.11 X |
| 3,942,685 | 3/1976 | Lindner | 222/129.1 |
| 3,949,903 | 4/1976 | Benasutti et al. | 222/129.2 |
| 4,226,267 | 10/1980 | Meacham, Jr. | 141/18 |
| 4,294,285 | 10/1981 | Joslyn | 137/625.11 |
| 4,458,708 | 7/1984 | Leonard et al. | 137/625.11 X |
| 4,523,854 | 6/1985 | Beckley | 366/132 |
| 4,691,850 | 9/1987 | Kirschmann et al. | 222/642 |
| 4,730,637 | 3/1988 | White | 137/62 |
| 4,969,576 | 11/1990 | Merrill et al. | 222/1 |
| 4,971,118 | 11/1990 | Cluff | 141/105 X |
| 5,014,211 | 5/1991 | Turner et al. | 364/478 |
| 5,033,649 | 7/1991 | Copeland et al. | 222/132 |
| 5,069,883 | 12/1991 | Matonte | 141/234 X |
| 5,105,851 | 4/1992 | Fogelman | 137/625.11 |
| 5,255,820 | 10/1993 | Thomas | 222/1 |
| 5,259,557 | 11/1993 | Spriggs et al. | 239/304 |

FOREIGN PATENT DOCUMENTS

| | | | |
|---|---|---|---|
| 0467513 | 1/1992 | European Pat. Off. . | |
| 0544072 | 6/1993 | European Pat. Off. . | |
| 555875 | 9/1943 | United Kingdom . | |
| 9219530 | 11/1992 | WIPO | 141/105 |

*Primary Examiner*—J. Casimer Jacyna

*Attorney, Agent, or Firm*—Merchant, Gould, Smith, Edell, Welter & Schmidt, P.A.

[57] ABSTRACT

A solution storage and dispensing apparatus and method of operation therefor are disclosed. The solution storage and dispensing apparatus includes a selector valve and a control valve which selectively output a liquid such as water to one of a plurality of storage containers. Each container has an aspirator mounted therein which receives the water and a chemical concentrate to form a solution therein. A container is filled by selecting the container using the selector valve and actuating the control valve to dispense water to the selected container.

19 Claims, 3 Drawing Sheets

METHOD AND APPARATUS FOR STORING AND DISPENSING CHEMICAL SOLUTIONS

FIELD OF THE INVENTION

The present invention relates generally to a solution dispensing system, and more particularly to a solution dispensing system in which a liquid such as water is selectively dispensed to a plurality of containers for forming chemical solutions therein.

BACKGROUND OF THE INVENTION

In janitorial settings which require a significant amount and number of specialized cleaning solutions, the liquid cleaning products are typically purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning products. The dispensers usually feature at least some of the following components: a container for the concentrated cleaning product, a storage container for the diluted cleaning product, a method to dose concentrate into the storage container, and a water supply line to dilute the concentrate.

The dispensing systems cover a wide range in terms of their complexity. That is, the method of dilution may be rather simple and manual in nature, but requires a great deal of operator experience. On the other hand, the dispensing systems may be quite complex, requiring several mechanical devices to dilute the concentrates. Such complex systems are often necessary where different cleaning products and different dilution ratios are utilized for different cleaning applications, These dispensing systems typically require several separate water lines, each water line corresponding to a different type of cleaning concentrate. The requirement of multiple water lines also greatly limits the locations at which the dispensing systems can be placed, and such systems are generally not portable. Accordingly, solution containers such as spray bottles and mop buckets typically must be filled and taken to the point of usage by the janitorial personnel.

The cost of these conventional dispensing stations is typically relatively high, because of their complexity and because backflow preventers are generally required for each water connection by applicable plumbing codes, and pressure regulators are necessary to control use solution concentrations within an acceptable range. Other necessary flow control devices also add to the cost of conventional dispensing systems; for example, a pick-up probe and foot valve must be employed in order to withdraw the concentrate from a rigid container.

One type of system which offers significant improvements over many of the more complex conventional systems is disclosed in U.S. Pat. No. 5,255,820 issued to Thomas. To the extent necessary to support this disclosure, the disclosure of this reference is incorporated by reference herein.

The system disclosed in Thomas includes a number of solution storage containers and concentrate containers preferably arranged on a rack. One or more aspirators are mounted to the rack, and the storage and concentrate containers may be individually connected to the aspirators through quick release connections. A diluent such as water is provided through a gun assembly which may be attached to a water inlet port of the aspirator through a releasable, quick connection fitting. When it is desired to fill a storage container with a solution, the appropriate storage container and concentrate container lines are connected to the aspirator, and then the gun assembly is connected to the aspirator and actuated to dispense water or other diluent through the aspirator and into the storage container. By virtue of the vacuum created in the aspirator, a controlled quantity of concentrate is also drawn into the storage container to form the solution.

This system offers significant advantages over other conventional systems as it is capable of providing controlled concentrations of solutions in a simple, easy and cost effective manner. However, while the quick release fittings between the various components of the system are comparatively easy to operate, selection of different storage containers and/or concentrates requires individual fluid lines to be rerouted between the storage and concentrate containers and the aspirators.

Another system which offers significant improvements over more complex conventional solution storage and dispensing systems is disclosed in U.S. Pat. No. 5,033,649, issued to Copeland et al. To the extent necessary to support this disclosure, the disclosure of this reference is also incorporated by reference herein.

Copeland et al. discloses a chemical solution dispensing and handling system which includes a storage container having an aspirator or other proportioning means disposed inside the container. Quick release fittings are provided to the aspirator to connect the lines running from a water source and a source of concentrate. The Copeland et al. system also provides for controlled concentrations of solution through the use of metering tips in the aspirator which control the respective flow rates of the water and concentrate.

The Copeland et al. device also offers the advantage of being simple, inexpensive and reliable. In particular, the container may be filled with solution merely by controlling the flow of water or diluent into the aspirator. However, each Copeland et al. system stores a single solution in a single storage container, thus requiring a plurality of such systems to provide a plurality of chemical solutions. Also, selection of the system to fill often requires rerouting of a transferrable water line to the system.

SUMMARY OF THE INVENTION

The invention addresses these and other problems associated with the prior art in providing a solution storage and dispensing apparatus for forming solutions in a plurality of storage containers using a single dispenser to selectively direct a first liquid such as water to each of the storage containers for forming solutions therein. In a preferred embodiment, an aspirator disposed in each of the storage containers draws a second liquid such as a concentrate into the storage container in response to the flow of the first liquid through the aspirator to provide a controlled concentration of solution in the container. A container is filled with solution by selecting the container to be filled through a selector valve, then actuating a control valve to dispense the first liquid through the aspirator of the selected container to draw in the second liquid and thereby form a solution. In this manner, a plurality of storage containers may be filled through a single connection to a source of first liquid.

In accordance with one aspect of the invention a solution storage and dispensing apparatus is provided which includes first and second containers, each having first and second inlet ports for receiving first and second liquids from first and second liquid sources, respectively, a selector valve having an input and first and second outputs, and a control valve, in fluid communication with the first liquid source, for selectively controlling the flow of the first liquid to the selector valve. The first and second inlet ports of each container are in fluid communication with a proportioning means, outletting into the container, for proportioning the relative flow rates through the first and second inlet ports. The first and second outputs of the selector valve are in fluid communication with the first inlet ports of the first and second containers, respectively. The selector valve is selectable between first and second positions for placing its input in fluid communication with the first and second outputs, respectively.

In accordance with a further aspect of the invention, a method for filling containers is provided. The method includes the steps of providing a plurality of containers, each having first and second inlet ports for receiving first and second liquids from first and second liquid sources, respectively, selecting one of the containers to fill by selecting one of a plurality of positions of a selector valve having an input and a plurality of outputs, at least a portion of which are in fluid communication with the first inlet ports of the containers, and actuating a control valve disposed in fluid communication between the first liquid source and the input of the selector valve to dispense the first fluid through the selector valve and thereby dispense the first and second fluids into the selected container. The first and second inlet ports of each container are in fluid communication with a proportioning means, outletting into the container, for proportioning the relative flow rates through the first and second inlet ports.

In accordance with an additional aspect of the invention, an apparatus for dispensing a first liquid from a first liquid source to one of a plurality of containers is provided. Each container is of the type for storing a solution including the first liquid and a second liquid from a second liquid source, and each has first and second inlet ports for receiving the first and second liquids, respectively. The apparatus includes a selector valve having an input and a plurality of outputs. Each output is in fluid communication with the first inlet port of one of the containers, and the selector valve is selectable between a plurality of positions to select one of the containers to fill by placing the input of the selector valve in fluid communication with one of the outputs. The apparatus also includes a control valve, in fluid communication with the first liquid source, for selectively controlling the flow of the first liquid from the first liquid source to the selector valve such that when the control valve is actuated, the first liquid is directed to the selected container to mix with the second liquid and form a solution in the container.

These and other advantages and features which characterize the invention are pointed out with particularity in the claims annexed hereto and forming a part hereof. However, for a better understanding of the invention, its advantages and objectives obtained by its use, reference should be made to the Drawing which forms a further part hereof and to the accompanying descriptive matter, in which there is described a preferred embodiment of the invention.

DETAILED DESCRIPTION OF THE PREFERRED EMBODIMENT

Figure 1:
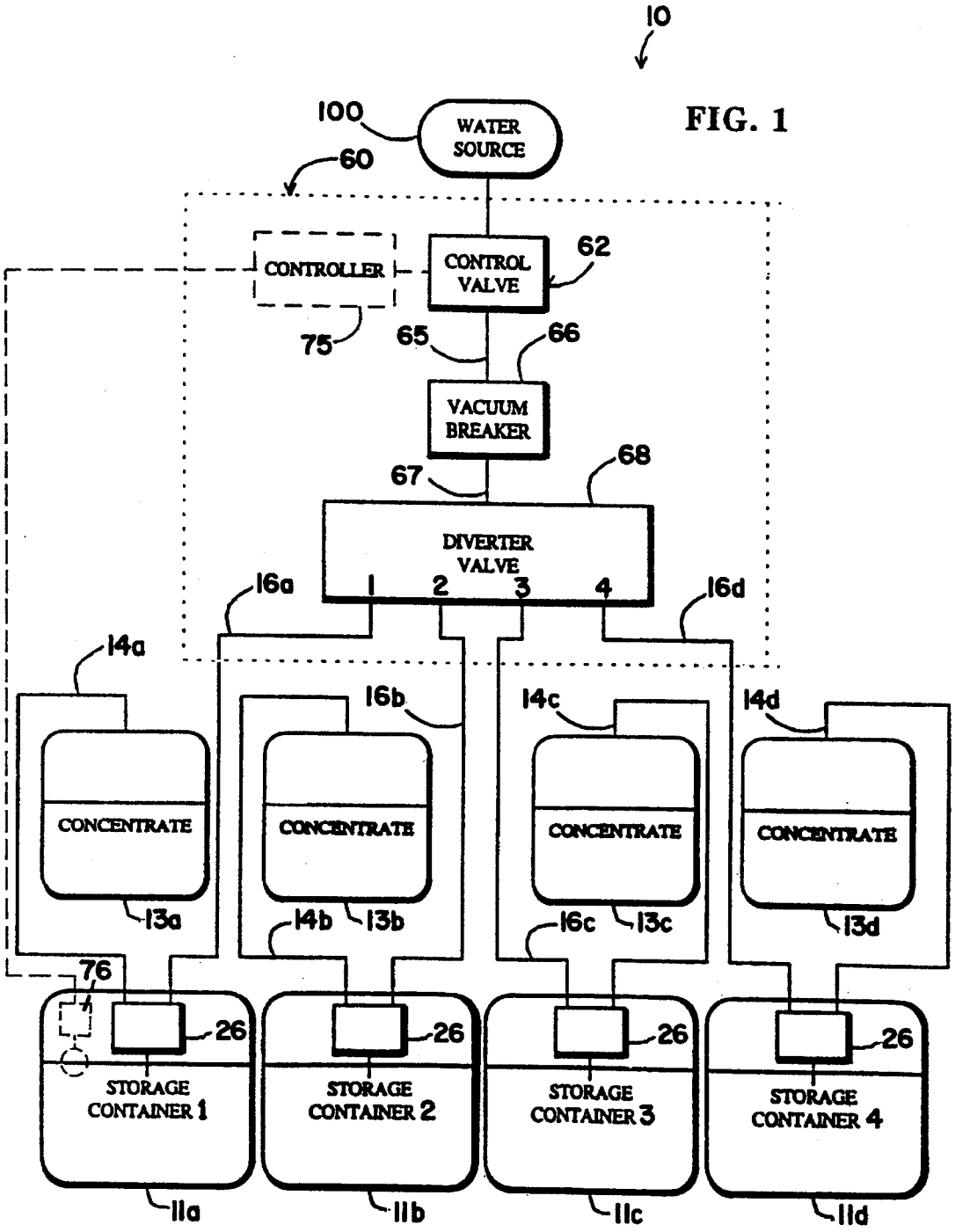
FIG. 1 is a functional block diagram of a solution storage and dispensing apparatus consistent with the invention.

Turning to the FIGS., wherein like parts are denoted by like numbers throughout the several views, FIG. 1 shows a preferred solution storage and dispensing apparatus 10. While the apparatus as disclosed herein is for use with storing and dispensing cleaning products for use by institutional users such as hotels, hospitals, restaurants, etc., it will be appreciated by one skilled in the art that the principles of the invention may be applied to other applications in which there is a need for a cost effective, reliable, and simple system for directing a liquid to a plurality of dispensing points. Therefore, the discussion below regarding the use of the invention in conjunction with dispensing cleaning solutions is provided merely for the purpose of illustration.

FIG. 1 shows a preferred solution storage and dispensing apparatus 10 for selectively filling four storage containers 11*a*, 11*b*, 11*c*, and 11*d* with diluted solutions. Each container preferably includes an aspirator or other proportioning means 26 to control the concentration of the solutions formed in the individual containers. As discussed in greater detail below, aspirators 26 may be internal or external to the respective containers, and they may include metering tips or other similar components to facilitate the regulation of solution concentrations in the containers.

Containers 11*a–d* are configured to receive first liquids through lines 16*a–d* and second liquids through lines 14*a–d*. The first and second liquids are proportioned by means of aspirators 26 to form solutions in the containers.

The first liquid is preferably water or another diluent. However, it will be appreciated that many types of liquids may be used consistent with the invention.

The second liquid is preferably a cleaning concentrate which is diluted by the first liquid in the resulting solution. Examples of the types of cleaning concentrates utilized with the preferred embodiment of the invention are: multi-purpose cleaners, e.g., for walls, windows, tile and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution. Further, liquids other than concentrates may also be utilized consistent with the invention.

It will be appreciated that while four storage containers 11*a–d* are shown in the preferred embodiment, any number of such containers may be provided consistent with the present invention. For example, as few as two containers may be used.

Each storage container 11*a–d* is placed in fluid communication with a corresponding concentrate container 13*a–d* through one of lines 14*a–d*, to provide a source of a second liquid such as a cleaning concentrate for forming a diluted cleaning solution. It will be appreciated that more than one container 11*a–d* may be connected to a concentrate container 13*a–d*, and that more than one concentrate may be supplied to each container 11*a–d*. Furthermore, containers 11*a–d* are also in fluid communication with a first liquid dispenser 60 through lines 16*a–d* to receive a first liquid such as water from a first liquid source (e.g., a water supply).

Dispenser 60 preferably receives water from water source 100 through line 70. Water source 100 typically provides water at a pressure in the range of 30 to 70 psi, preferably in the range of 40 to 50 psi. It will be appreciated that a pressure regulator or other components may be required to regulate the water pressure accordingly.

A control valve 62 is connected to line 70, and is preferably configured to provide bistable operation (i.e., the valve is either fully open or fully closed). However, it will be appreciated that a variable valve could also be used consistent with the invention.

A vacuum breaker 66 is preferably connected to control valve 62 through line 65. Vacuum breaker 66 operates as a back flow preventer, which is required by many plumbing codes, although vacuum breaker 66 is not required for the proper operation of the invention.

A selector valve 68 is connected to vacuum breaker 66 through line 67. Selector valve 68 is selectable between a plurality of positions. Selector valve 68 includes an input and a plurality of outputs, and the selector valve is configured such that one of the outputs is placed in fluid communication with the input in each of the plurality of positions of the valve. The outputs are in turn connected to containers 11*a–d* through lines 16*a–d*. Therefore, the container 11*a–d* to be filled is selected by selecting the corresponding position of selector valve 68.

It will be appreciated that one or more additional outputs may be provided on selector valve 68 so that water may be supplied directly to an output faucet, hose or other type of discharge port to provide, for example, a source of rinse water. Furthermore, it will be appreciated that the operation of selector valve 68 may alternatively be performed by separate valves. However, it has been found that the use of separate valves is more complex and expensive given that more components are required, and also that some form of mechanical lock out mechanism would typically be required to prevent the actuation of two outputs at once. This may be important since actuating two outputs at once may not provide sufficient water pressure to adequately control the concentration of the resulting solutions.

The solution storage and dispensing apparatus 10 is preferably operated as follows. Suitable concentrates are provided in concentrate containers 13*a–d*, and the apparatus is connected to a suitable water source through line 70. Next, the container to be filled with solution is selected by selecting the corresponding position of selector valve 68. Then, control valve 62 is actuated to dispense the water to the selected container, whereby passage of the water through the aspirator draws the corresponding concentrate into the container to form the resulting solution. Once a sufficient amount of solution has been formed in the container, further dispensing is terminated by closing control valve 62.

Several advantages are realized by preferred apparatus 10. In particular, the apparatus is significantly easier to operate than many conventional systems since, once the water line and respective concentrate containers are connected to the apparatus, a container may be filled with solution merely by selecting the proper container with the selector valve, then actuating the control valve to dispense the solution. Unlike prior systems, there is no need to connect individual lines or gun assemblies to the individual containers or aspirators each time a solution is dispensed.

Furthermore, by providing individual aspirators for each container, there is no need to reconfigure a single aspirator to dispense different solutions in different containers. Also, by including individual aspirators, the respective flow rates can be optimized for each solution to be dispensed. In addition, there may be a significant space saving insofar as the aspirators may be provided within each of the storage containers.

Providing individual aspirators also reduces cross-contamination between solutions. In many conventional systems, water is directed to a single aspirator, and a concentrate dispenser is utilized to provide different concentrates to the common aspirator. Different concentrates are dispensed through a single channel, which allows mixing and contamination to occur between solutions. On the other hand, the preferred apparatus reduces or eliminates cross-contamination because the water, and not the concentrate, is selectively dispensed, and because individual aspirators are used on each container.

The preferred apparatus also is significantly less complex and expensive than many conventional systems. For example, only one water line and back flow preventer is required to fill a plurality of storage containers. To this extent, the invention provides a substantially portable and stand alone system whereby only one external connection (which is preferably to a water supply) is required to operate the system. Preferably, the control valve and selector valve require no electrical connections to operate, and therefore no separate electrical source is required to operate the system. In addition, the preferred apparatus is substantially modular, allowing a wide variety of types of solutions to be stored and dispensed in a single system.

Furthermore, the preferred apparatus is relatively safe and clean, as it is substantially closed to reduce splashing and spilling of the solution. This may be particularly important when the solutions involved are caustic or dangerous in that the exposure of operators to the concentrates and solutions thereof is minimized.

Figure 2:
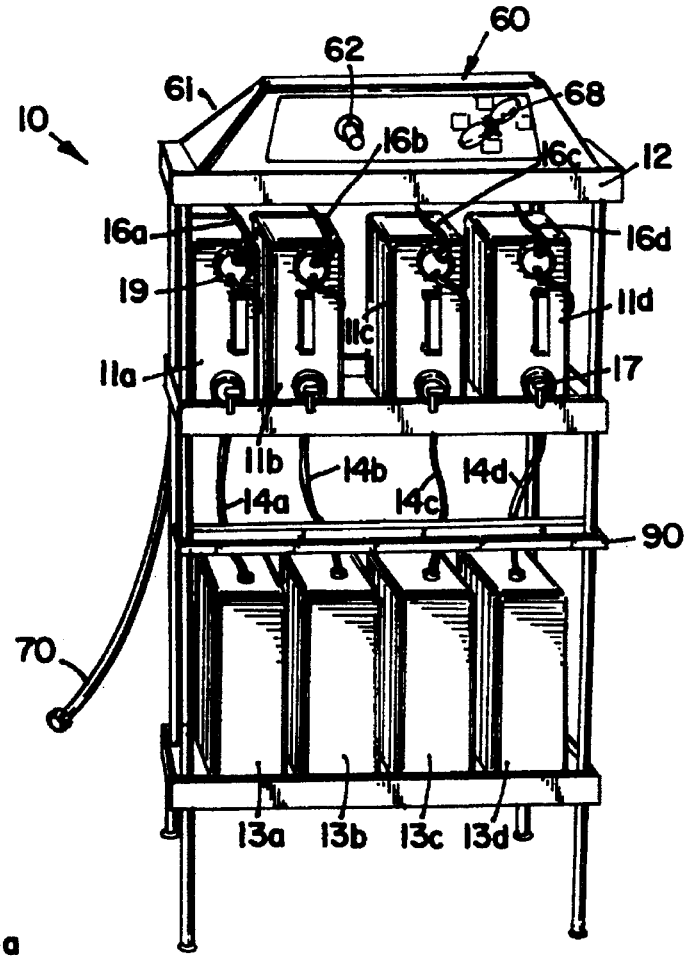
FIG. 2 is a perspective view of the solution storage and dispensing apparatus of FIG. 1.

One physical embodiment of the preferred storage and dispensing apparatus of FIG. 1 is shown in FIG. 2. The apparatus 10 is preferably supported by a rack or cart 12 which may be supported on wheels (not shown) so as to allow the cart assembly to be moved as necessary after disconnection from the water supply line 70. The apparatus 10 includes the containers 13*a–d* for the concentrated solutions. The rack 12 also supports storage containers 11*a–d* which store the diluted cleaning products or solutions. The containers 11*a–d* have a spigot 17 which can be opened for filling spray bottles (not shown) which are supported upon a shelf 90. The containers 11*a–d* are preferably approximately three to five gallons in size.

In the preferred embodiment, the product concentrates are supplied from containers 13*a–d*. Cart 12 may be configured to accommodate a plurality of these containers, as illustrated in FIG. 2. Containers 13*a–d* preferably are rigid containers, and the ends of pick-up tubes 14*a–d* connected thereto are provided with suitable pick-up probes and foot valves (not shown) which allow venting to equalize pressure. Alternatively, containers 13*a–d* may be collapsible, bladder type packages or containers which collapse as concentrate is withdrawn therefrom. With this alternate type of container, the pick-up tubes 14*a–d* would typically be attached to apertures in the bladder bags by means of threaded connections.

Figure 3:
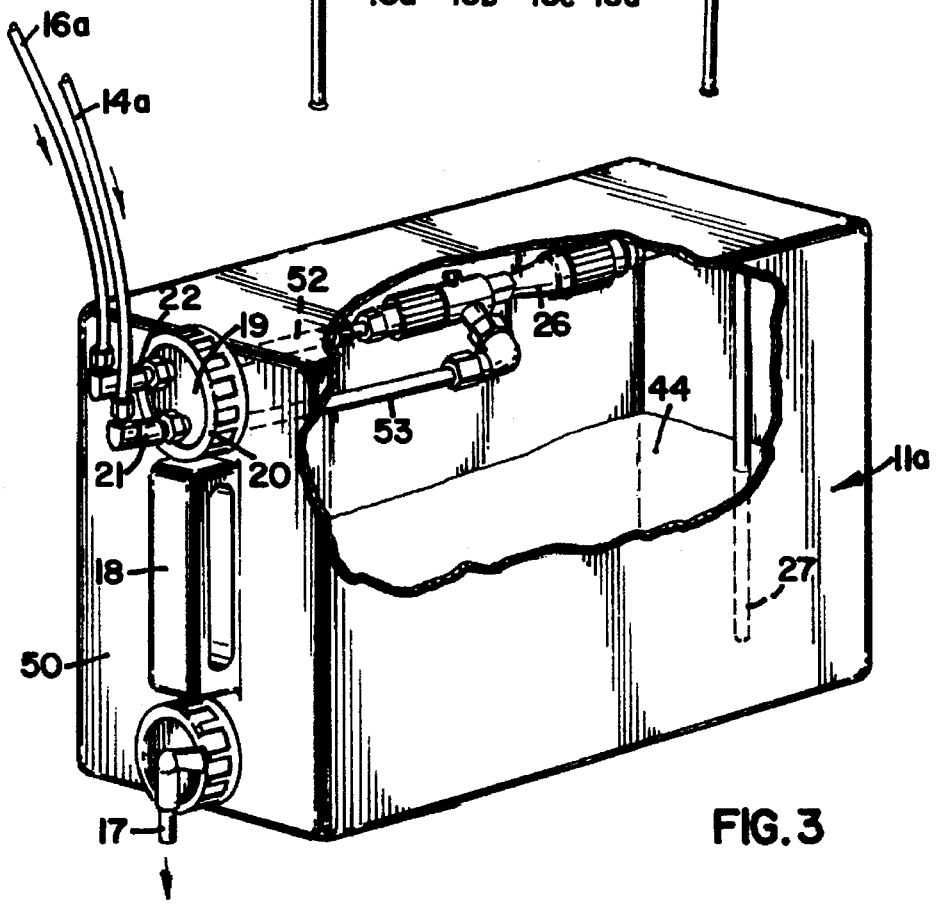
FIG. 3 is a perspective view of one of the storage containers shown in FIGS. 1 and 2, with a portion thereof partially cut away.

FIG. 3 shows one of the preferred storage containers 11*a* in which the diluted cleaning product or other solution is stored before dispensing. As discussed above, pick-up tube 14*a* transports concentrate into the container 11*a*. Further, water supply line 16*a* is received from dispenser 60, and it provides a conduit for water or another type of diluent into container 11*a*.

The water is mixed with the concentrate and the diluted product is stored within container 11*a*. That is, the concentrated product conduit 14*a* and line 16*a* feed into the storage container or jug 11*a* so that the container 11*a* contains the diluted cleaning product. The container 11*a* is preferably approximately three to five gallons in size. However, it will be appreciated that various different sizes and shapes of containers may alternatively be used.

Container 11*a* has a spigot 17 from which the cleaning solution can be dispensed into spray bottles or other containers (not shown). The storage container 11*a* holds the use solution so that the spray bottles can be easily filled without the necessity of activating dispenser 60. The outlet or spigot 17 contains a suitable valve and control handle for activating discharge of the use solution 44. In the preferred embodiment, the diluted solution is dispensed at a rate of approximately two gallons per minute.

The front end 50 of the storage container 11*a* preferably includes a handle 18 which allows the storage container 11*a* to be easily transported when either empty or filled. This is advantageous if the janitorial personnel wish to take the storage container 11*a* to a point of usage. In addition, a vent system (not shown), open to the atmosphere, may also be provided on use container 11*a*.

The storage container 11*a* also includes a cap assembly 19 at its front end toward the upper part of the container. The cap assembly 19 preferably includes a threaded, annular ring 20 which attaches to the storage container 11*a*. A gasket (not shown) is preferably provided to prevent leakage. The cap assembly 19 has two apertures or ports 21, 22 which accommodate the two connection fittings for the inlet lines 14*a*, 16*a*. It is to be understood that more than two inlet ports could be provided in the cap assembly 19 or storage container 11*a*, if it were desired that more than two inlet lines were necessary. That is, it is within the scope of the invention to fill the use container 11*a* with more than one concentrated solution. With this design, an additional orifice or port would be provided for the additional product pick-up tube, and the aspirator design would be varied as necessary.

The internal means for proportioning the concentrate and water is illustrated by the cutaway portion of the container 11*a* shown in FIG. 3. Preferably, the proportioning means comprises an aspirator 26 which is built into the storage container 11*a*. In the preferred embodiment, the storage container 11*a* and aspirator assembly 26 are made from a suitable plastic material such as high density polyethylene. The aspirator can be manufactured as an insert to fit within the container as illustrated in FIG. 3. Alternatively, the aspirator 26 can be mounted within the container 11*a* by suitable means such as spin welding or use of an adhesive, or the container assembly 11*a* can be blow-molded around the aspirator assembly 26.

The aspirator operates so that when a source of detergent concentrate is connected to the vacuum inlet of the aspirator 26, the container 11*a* is filled with a diluted detergent 44. The vacuum created by water from line 16*a* flowing through the aspirator is utilized to withdraw the proper proportion of concentrated cleaning solution from its container 13*a* (FIG. 2). In this manner, the water and concentrate enter the container 11*a* simultaneously, as illustrated by the arrows in FIG. 3. Water passes through the aspirator 26, and the aspirator's output fills the product use container 11*a*.

An alternative proportioning means other than the aspirator 26 can be utilized. For example, an electric or mechanical pump could be employed to provide the proper proportions.

Within the container 11*a* are a water tube 52 and a concentrate tube 53, both tubes leading into the aspirator 26. The aspirator is in fluid communication with a discharge tube 27. The discharge tube 27 extends proximate the bottom of the container 11*a*. This allows for underwater dispensing to minimize foaming. Preferably, the walls of the container 11*a* are translucent or clear so that the user can see how much solution 44 is in the container 11*a*.

The blend ratio, or proportion of chemical to water, is set by flow metering means, such as interchangeable metering tips in aspirator 56. Each metering tip may be sized and configured to correspond to a particular proportion ratio. Different dilution ratios are sometimes needed for different applications, e.g., one application might require a 1% solution, whereas another application may require a 10% solution of the same product. Alternatively, an adjustable metering screw may be utilized to enable the proportion ratio to be adjusted.

In the preferred embodiment, the product pick-up tubes 14*a–d* are approximately ⅜ inch in diameter. These dimensions allow for adequate aspirator efficiency, and a larger tube diameter would allow for a longer pick-up tube to be utilized.

The pick-up tubing 14*a–d* is preferably transparent or translucent, so that the user can verify when it is filled with concentrate. It is desirable for the pick-up tube 14*a–d* to be completely filled and not contain air.

The upper end of the pick-up tube 14*a–d* preferably has an integrated check valve 31. An additional check valve, such as an umbrella check valve, may also be included in the lower end of the tube. In this manner, the pick-up tube 14*a–d* is completely closed by having a valve at each end. This allows the pick-up tube 14*a–d* to be disconnected without any spillage.

A quick connect assembly is provided at each end of the pick-up tube 14*a–d* to facilitate such connection and disconnection. One quick-connect assembly is utilized in the preferred embodiment to interconnect the pick-up tube 14*a–d* and water supply tube 16*a–d* with the inlet ports 21, 22 in the cap assembly 19 of each container 11*a–d*.

Returning to FIG. 2, containers 11*a–d* are connected to lines 16*a–d* which are routed from dispenser 60, which is shown disposed on the top of rack 12. It will be appreciated that dispenser 60 may be disposed anywhere on rack 12. Furthermore, it will be appreciated that dispenser 60 may be provided as a separate unit, and further with each storage container being provided on a separate assembly. Other physical configurations of the preferred solution storage and dispensing apparatus will be appreciated by one of ordinary skill in the art.

Figure 4:
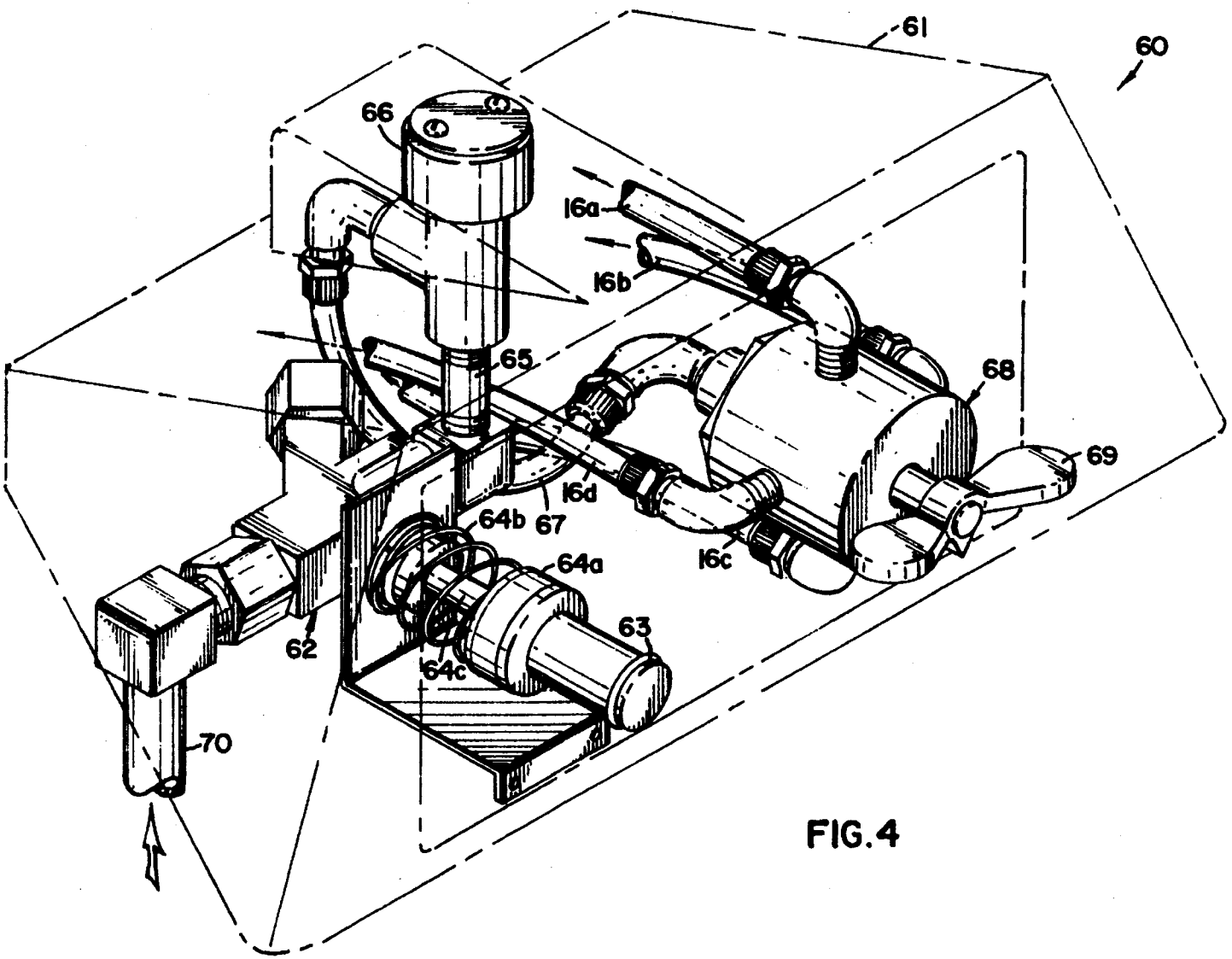
FIG. 4 is a perspective view of the dispenser shown in FIGS. 1 and 2, with the housing thereof shown in phantom.

A preferred dispenser 60 is shown in greater detail in FIG. 4. The components of dispenser 60 are preferably mounted in a housing 61 (shown in phantom) which is provided primarily for decorative purposes. It will be appreciated that a wide variety of materials and designs may be provided for housing 61.

As shown in FIG. 4, control valve 62 is preferably a mechanically-actuated permanent magnet solenoid valve, such as the No. 442 valve manufactured by Dema Engineering of St. Louis, Mo. In this type of valve, a permanent magnet 64*a* is biased by a spring 64*b* to pull a plunger (not shown) inside of tube 64*c* to open a diaphragm (not shown), thus allowing the flow of water from input line 70 through control valve 62. Control valve 62 is opened by depressing push button 63, which axially displaces magnet 64*a*. The plunger disposed inside tube 64*c* is attracted to permanent magnet 64*a*, and consequently, when magnet 64*a* is displaced inwardly, the plunger is displaced outwardly to unseat the diaphragm, thereby opening control valve 62. Control valve 62 is returned to a closed configuration by releasing push button 63, which returns magnet 64*a* to its outer position, thereby drawing the plunger inward and reseating the diaphragm.

Any number of mechanically or electrically-actuated valves may be used as an alternative to control valve 62. However, it has been found that control valve 62 is simple, inexpensive, and reliable, and further does not require an electrical connection for its operation. Therefore, this valve is particularly suited to low cost portable stand alone applications since no separate power source is required.

Control valve 62 is connected by line 65 to a vacuum breaker 66 which provides back flow prevention as is required by many plumbing codes. Vacuum breaker 66 is preferably an atmospheric vacuum breaker such as a Watts No. 288A vacuum breaker manufactured by Watts Regulator. It has been found that this type of vacuum breaker must be placed downstream of the control valve to ensure proper operation. However, various other backflow preventers are also known in the art, many of which may be used upstream or downstream of control valve 62.

Vacuum breaker 66 is connected by line 67 to an input port of selector valve 68. Selector valve 68 also includes four outputs which are connected to lines 16*a–d*, to place the four outputs in fluid communication with containers 11*a–d*.

Selector valve 68 is preferably a rotary diverter valve which is actuated by knob 69, such as a PSV 14-5 5-way valve manufactured by Conant Inc. However, other mechanical and/or electric selector valves, and means for actuating them, are also known in the art. By rotating knob 69, various positions may be selected to place the input port of selector valve 68 in fluid communication with one of its outputs, thereby selecting the storage container to be filled which is in fluid communication with the selected output of the selector valve. Also, as discussed above, greater or lesser numbers of outputs, as well as outputs which are connected directly to discharge ports may be provided.

It will be appreciated that various known configurations of fittings, pipes, and brackets may be used to interconnect the components of dispenser 60 in the manner disclosed herein.

Various modifications may be made to the preferred embodiment without departing from the spirit and scope of the invention. For example, various degrees of electronic control may be provided to increase the sophistication of the solution storage and dispensing apparatus 10. For example, as shown in FIG. 1, an electronic controller 75 may optionally be provided to control the actuation of control valve 62. This could allow for a timing operation whereby depression of push button 63 would actuate the control valve 62 for a fixed or predetermined period of time, thus providing a metered quantity of solution. This timer function could also be provided by any of a number of known mechanical means as well. In addition, the electronic control could be used to track the quantity of solution which has been dispensed by the apparatus, which may be useful for inventory control.

Furthermore, float switches (e.g., float switch 76) may be provided in the individual storage containers 11*a–d* such that control valve 62 may be automatically shut off when the volume of solution in the respective containers exceeds a predetermined level. This would prevent overfilling of the containers, as well as provide for a substantially automatic filling operation that is actuated merely by initially actuating the control valve. Other types of controls which may be provided by electronic controllers may also be used consistent with the invention.

Therefore, it will be appreciated that the present invention provides many significant advantages in providing a solution storage and dispensing apparatus which is less complex, less costly, and more reliable than many conventional systems. The above discussion, examples and embodiments illustrate our current understanding of the invention. However, one skilled in the art will appreciate that various additional changes and modifications may be made within the scope of the invention. Thus the invention resides solely in the claims hereafter appended.

We claim:

1. A solution storage and dispensing apparatus, comprising:

(a) first and second containers, each having first and second inlet ports for receiving water and a chemical concentrate, respectively, the first and second inlet ports being in fluid communication with a proportioning means, outletting into the container, for proportioning the relative flow rates through the first and second inlet ports;

(b) a selector valve having an input and first and second outputs, the first and second outputs in fluid communication with the first inlet ports of the first and second containers, respectively, wherein the selector valve is selectable between first and second positions for placing the input in fluid communication with the first and second outputs, respectively; and (c) a control valve, in fluid communication with a water source, for selectively controlling the flow of water to the selector valve, wherein the control valve is not connected to a source of electricity.

2. The apparatus of claim 1, wherein the proportioning means of each container comprises an aspirator disposed within the container for drawing chemical concentrate into the container responsive to the flow of water into the container to form a diluted solution comprising the chemical concentrate.

3. The apparatus of claim 2, wherein the proportioning means of each container further comprises a metering tip for proportioning the relative flow rates through the first and second inlet ports to control the concentration of the solution.

4. The apparatus of claim 2, wherein the proportioning means of each container further comprises a flexible discharge tube for outletting the solution into the container.

5. The apparatus of claim 1, wherein the selector valve comprises a rotary diverter valve.

6. The apparatus of claim 5, wherein the selector valve has a third output and is further selectable to a third position for placing the input in fluid communication with the third output, the third output in fluid communication with a discharge port.

7. The apparatus of claim 1, further comprising a backflow preventer in fluid communication between the water source and the selector valve.

8. The apparatus of claim 7, wherein the backflow preventer comprises an atmospheric vacuum breaker coupled between the control valve and the selector valve.

9. The apparatus of claim 1, wherein the control valve comprises a mechanically-actuated permanent magnet solenoid valve.

10. The apparatus of claim 1, further comprising a controller for actuating the control valve, the controller including timing means for actuating the control valve for a predetermined period of time.

11. The apparatus of claim 1, wherein each container further comprises a float switch for shutting off the control valve when the volume of liquids in the container exceeds a predetermined level.

12. The apparatus of claim 1, wherein the apparatus is disposed on a portable stand alone cart having a single external connection which connects the control valve to the water source.

13. A method for filling containers, comprising the steps of:

(a) providing a plurality of containers, each having first and second inlet ports for receiving water and a chemical concentrate, respectively, the first and second inlet ports being in fluid communication with a proportioning means, outletting into the container, for proportioning the relative flow rates through the first and second inlet ports;

(b) selecting one of the containers to fill by selecting one of a plurality of positions of a selector valve having an input and a plurality of outputs, at least a portion of which are in fluid communication with the first inlet ports of the containers; whereby the input to the selector valve is placed in fluid communication with the selected container when the selector valve is in the selected position; and (c) manually actuating a control valve disposed in fluid communication between a water source and the input of the selector valve to dispense water through the selector valve, and thereby dispense water and chemical concentrate into the selected container, wherein the control valve is not connected to a source of electricity.

14. The method of claim 13, wherein the proportioning means of each container comprises an aspirator disposed within the container for drawing chemical concentrate into the container responsive to the flow of water into the container to form a diluted solution comprising the chemical concentrate.

15. The method of claim 13, further comprising the step of outletting the solution into a use container through a spigot in the selected container.

16. The method of claim 15, further comprising the step of, after the actuating step, filling a second container by selecting the selector valve position corresponding to the second container and actuating the control valve to dispense water and chemical concentrate into the second container.

17. The method of claim 13, wherein the control valve comprises a mechanically-actuated permanent magnet solenoid valve.

18. An apparatus, comprising:

(a) a plurality of proportioning means, each having first and second inlet ports in fluid communication with an outlet port, and each for proportioning the relative flow rates of fluid through the first and second inlet ports, wherein the second inlet port of each proportioning means receives a chemical concentrate;

(b) a selector valve having an input and a plurality of outputs, each output in fluid communication with the first inlet port of one of the proportioning means, wherein the selector valve is selectable between a plurality of positions for placing the input in fluid communication with one of the plurality of outputs, respectively; and (c) a control valve, in fluid communication with a water source, for selectively controlling the flow of water to the selector valve, wherein the control valve is not connected to a source of electricity.

19. The apparatus of claim 18, further comprising a plurality of containers, wherein each proportioning means comprises an aspirator disposed within and outputting into one of the plurality of containers.

* * * * *